US007601052B1

(12) United States Patent
Eckerdt

(10) Patent No.: US 7,601,052 B1
(45) Date of Patent: Oct. 13, 2009

(54) KEY DESTROYER

(75) Inventor: George H. Eckerdt, Fishers, NY (US)

(73) Assignee: Key Systems, Inc., Fishers, NY (US)

( * ) Notice: Subject to any disclaimer, the term of this patent is extended or adjusted under 35 U.S.C. 154(b) by 0 days.

(21) Appl. No.: 12/059,488

(22) Filed: Mar. 31, 2008

(51) Int. Cl.
*B24B 23/00* (2006.01)

(52) U.S. Cl. ..... 451/282; 451/359

(58) Field of Classification Search ..... 451/359, 451/344, 453, 454, 455, 28, 278, 282
See application file for complete search history.

(56) References Cited

U.S. PATENT DOCUMENTS

| | | | | |
|---|---|---|---|---|
| 3,952,957 | A | 4/1976 | Maillet | |
| 4,069,619 | A * | 1/1978 | Escamilla | 451/65 |
| 4,133,489 | A | 1/1979 | Maillet | |
| 4,531,437 | A | 7/1985 | Szablak et al. | |
| 5,186,402 | A * | 2/1993 | Lin | 241/55 |
| 5,400,978 | A | 3/1995 | Strohmeyer | |
| 5,495,988 | A * | 3/1996 | Follese et al. | 241/36 |
| 5,676,591 | A * | 10/1997 | Huang | 451/359 |
| 5,911,372 | A | 6/1999 | Williams, Jr. | |
| 5,927,622 | A | 7/1999 | Zoellinger | |
| 6,676,500 | B1 * | 1/2004 | Lin | 451/359 |
| 6,976,648 | B2 | 12/2005 | Chang | |
| 7,222,805 | B1 | 5/2007 | Williams, Jr. | |
| 7,240,870 | B2 | 7/2007 | Lammers et al. | |
| 7,284,715 | B2 | 10/2007 | Dziesinski et al. | |
| 2007/0241216 | A1 | 10/2007 | Wada et al. | |
| 2007/0243029 | A1 | 10/2007 | Oliver | |

* cited by examiner

*Primary Examiner*—Robert Rose
(74) *Attorney, Agent, or Firm*—Brown & Michaels, PC

(57) ABSTRACT

A key destroyer preferably deploys an angle grinder fitted with a grinding chamber, cover, and insertion tube through which a key can be inserted to be destroyed. The key is gripped in a holder that can slide key foremost through the support tube so that the coded portion of the key can pass through a safety wall at the inner end of the support tube and engage a rotating abrasive disk that grinds away the coded portion of the key. The head of the destroyed key can then be retained as evidence that a particular copy of a key no longer exists.

25 Claims, 6 Drawing Sheets

KEY DESTROYER

BACKGROUND

Security sometimes requires that keys be destroyed. There is also a need to retain evidence of which keys have been destroyed. These capabilities can be important to keeping track of exactly how many copies of a key are outstanding and who is charged with their possession.

Besides having a convenient capacity to destroy a key and preserve evidence of the destroyed key, it is also desirable that key destroying equipment be inexpensive, safe, reliable, and easy to use.

SUMMARY

The invention meets these key destroying objectives by using a motor driven grinding element arranged within an enclosure into which a coded portion of a key can be thrust to be ground away. A holder is preferably used for this to grip a head of the key and also engage a hole in the head of the key so that the holder affords a firm grip on a key to be destroyed. The enclosure around the grinding element also preferably includes a tube through which the holder and a held key can be inserted, key-foremost, so that a coded portion of the key is ground away. The tube through which the holder and key are inserted provides support against lateral force applied by the grinding element to reduce any possibility of the key escaping or deviating from its intended path into engagement with the grinding element. The tube is also preferably guarded with a safety wall on its inner end, and the safety wall preferably has an oblong opening that receives only the coded portion of the key in an orientation that disposes a maximum width of the coded portion to the grinding element.

The tube, the safety wall, and the enclosure for the motor driven grinding element all cooperate to ensure that ground metal particles are captured and retained and do not escape to injure a person operating the key destroyer. The holder, tube, and grinding element enclosure also securely brace the advancing key against any movement other than a direct advance against the grinding element. The combined result protects an operator from injury, ensures that a key does not get loose and jamb or otherwise cause harm, and the enclosure collects and retains the metal particles from destroyed keys so that these can be dumped occasionally. The grinding element is also preferably replaceable.

The advance of the key into the grinding region is preferably limited by the safety end wall of the tube so that only the coded portion of the key is ground away. When this is done, the head of the key and its holder are withdrawn from the supporting tube so that the head of the ground away key can be retained as evidence that a particular key copy has been destroyed. The head of the key can bear an identification number for that purpose. Key security records can then be based upon the evidence retained in the form of heads of destroyed keys.

DRAWINGS

DESCRIPTION

Figure 1:
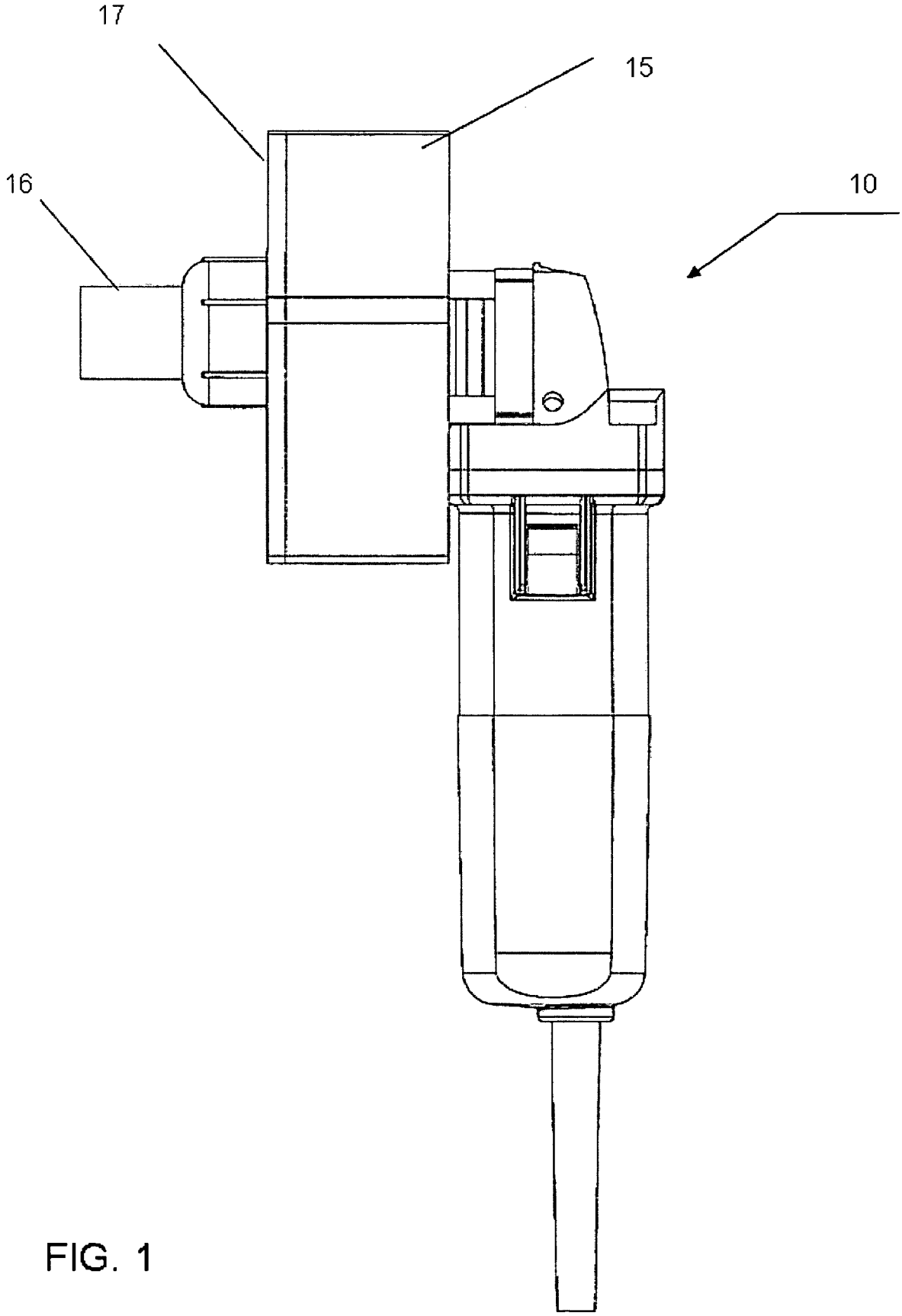
FIG. 1 is a plan view of a preferred embodiment of a key destroyer according to the invention.
Figure 2:
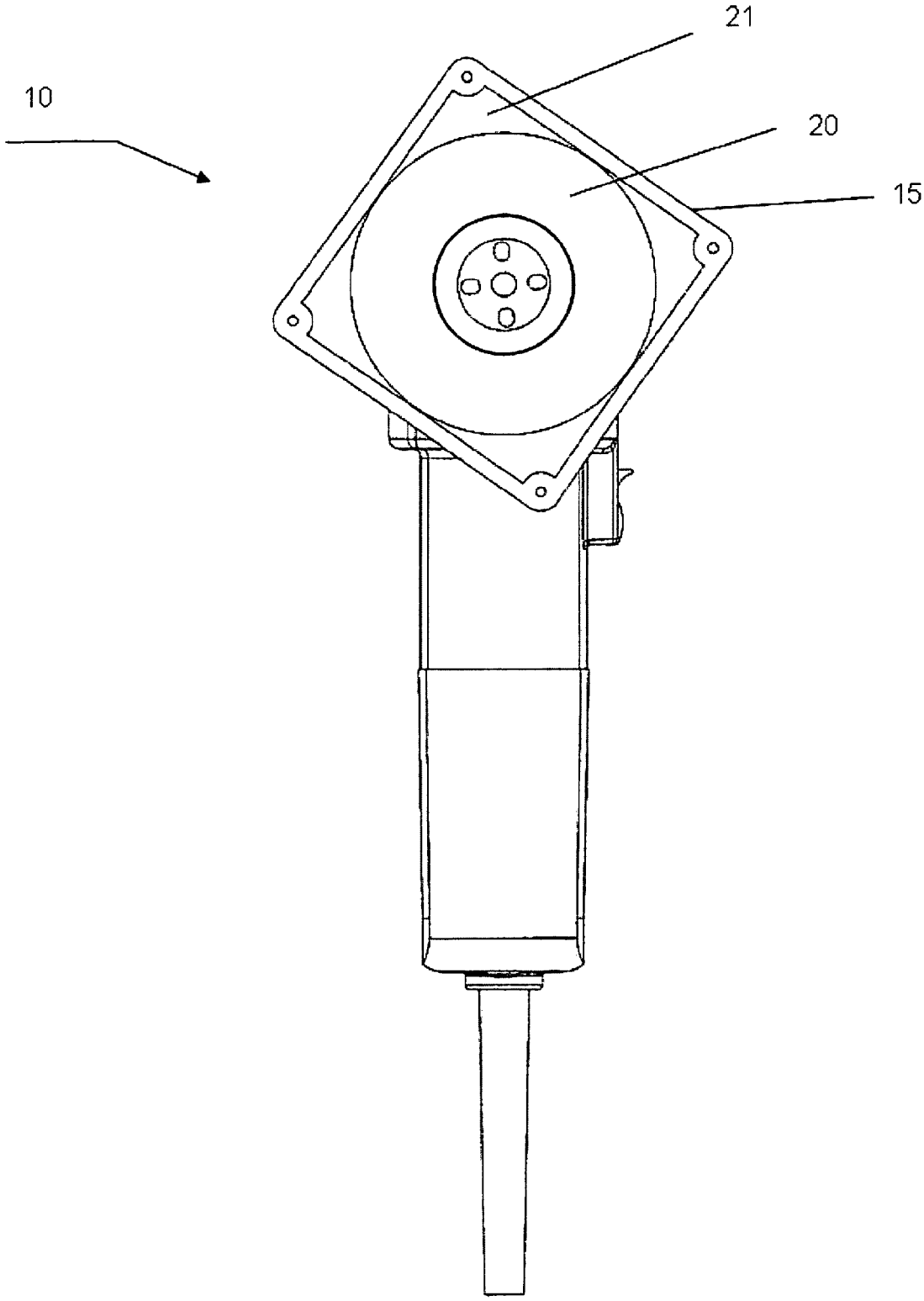
FIG. 2 is a front view of the key destroyer of FIG. 1 with a grinding enclosure cover removed.
Figure 3:
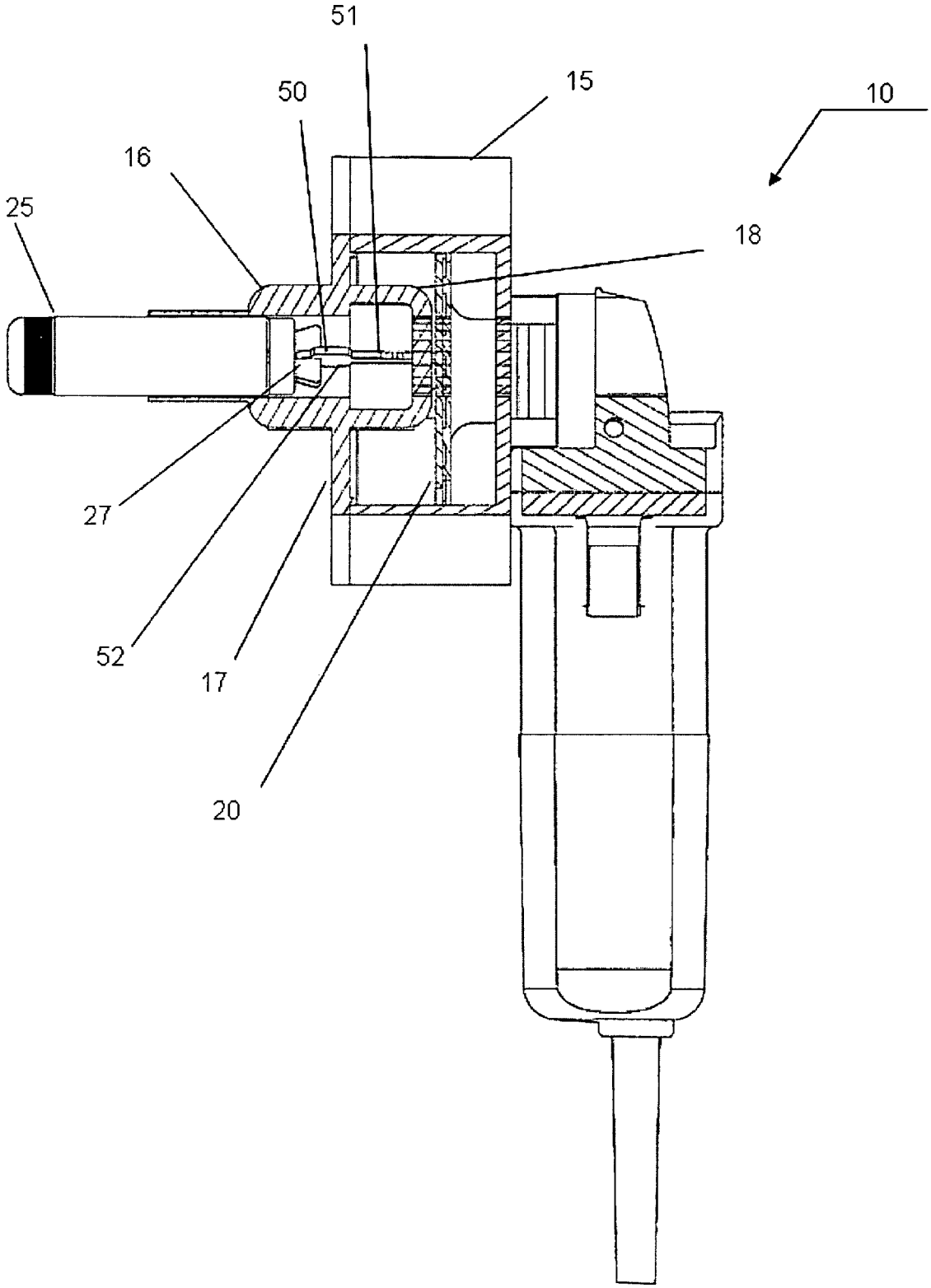
FIG. 3 is a partially cut-away view of the key destroyer of FIG. 1 showing a key and holder partially advanced against a motor driven grinding element.
Figure 4:
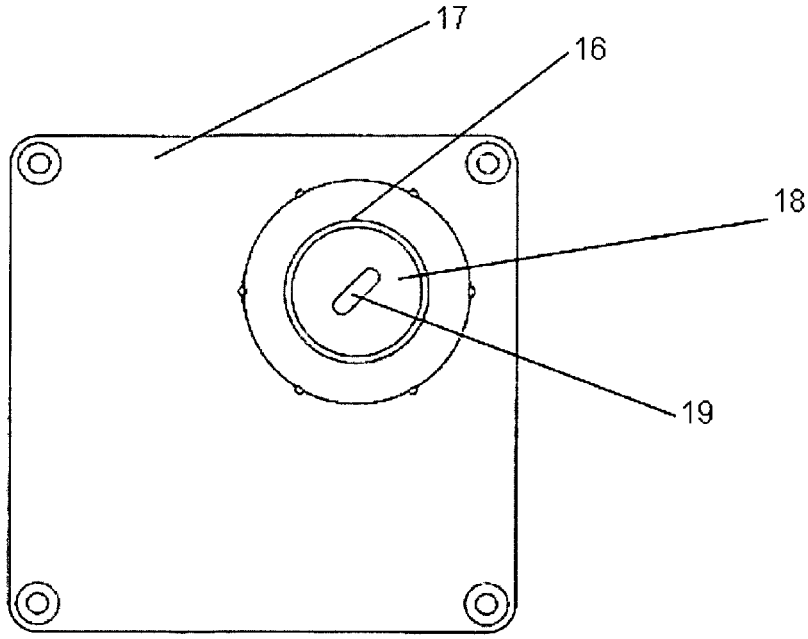
FIG. 4 is a plan view of a preferred cover for a grinding chamber of the key destroyer of FIGS. 1-3.
Figure 5:
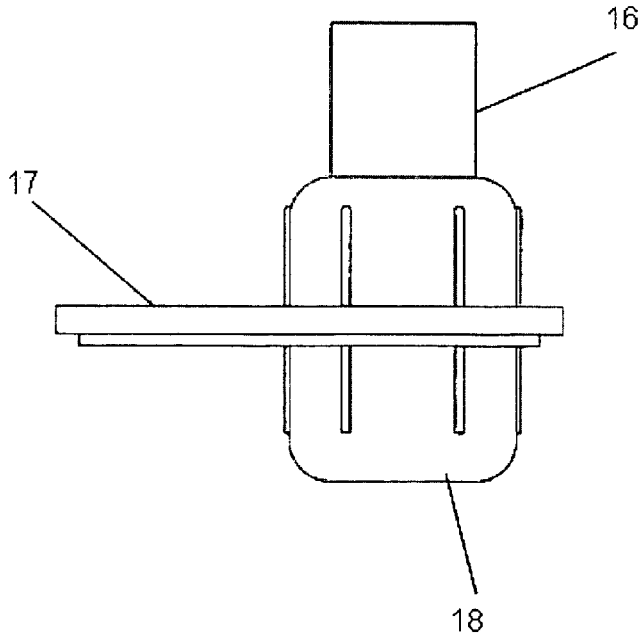
FIG. 5 is a side view of the cover of FIG. 4.
Figure 7:
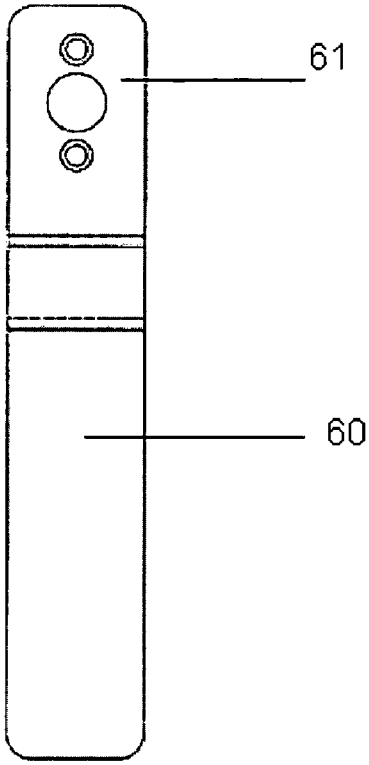
FIGS. 6 and 7 are respective side and face views of a wrench for changing the grinding element of the key destroyer of FIGS. 1-3.
Figure 6:
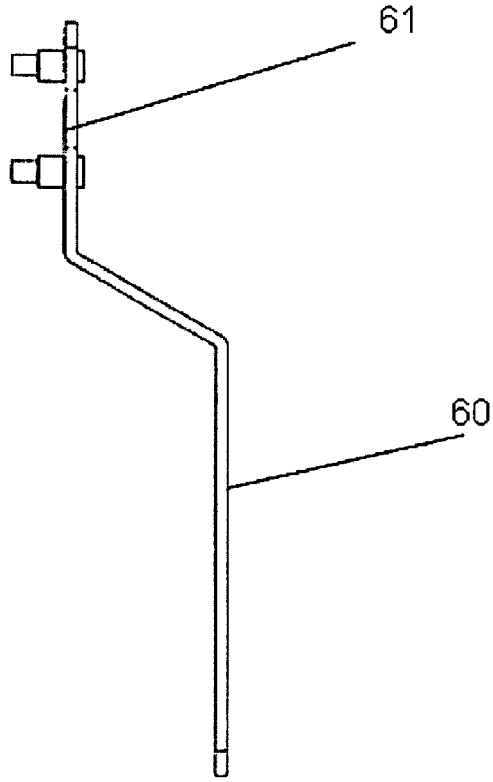
Figure 8:
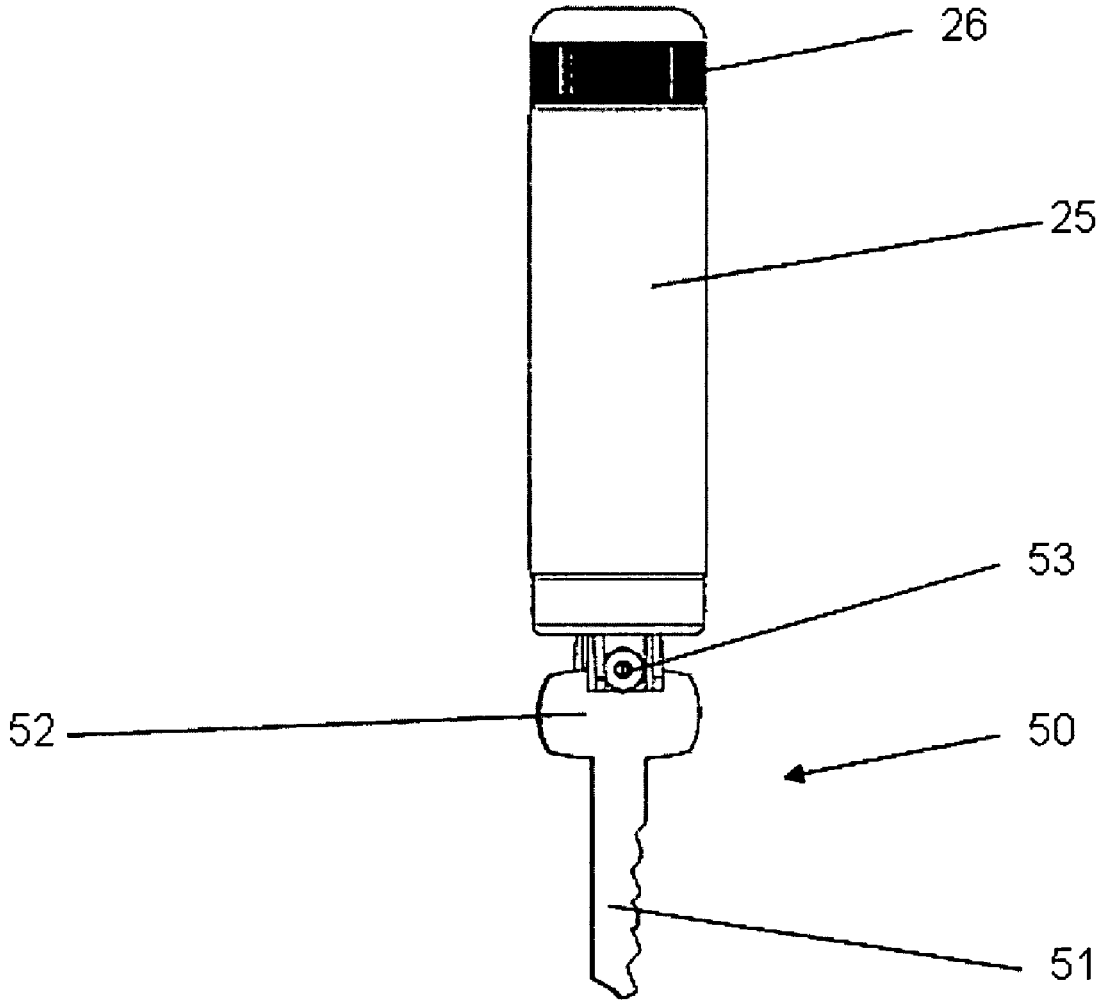
FIG. 8 is a plan view of a holder gripping a head of a key to be destroyed.

The inventive key destroyer uses a motor driven grinding element, preferably in a form that is readily available. This form, as best illustrated in FIGS. 1-3, is an angle grinder 10. Other forms of motor driven grinding elements are also possible, and the selection criteria include cost, effectiveness, safety, and noisiness.

Angle grinder 10 is fitted with a grinding enclosure 15 that contains a rotary driven, disk-shaped grinding element 20. A guide tube 16, preferably incorporated into a cover 17 of enclosure 15, leads into grinding region or chamber 21 within enclosure 15. Tube 16 is configured to allow holder 25 gripping a key 50 to be inserted through tube 16 so that a coded portion of key 50 can be pressed against grinding disk 20 and ground away so that key 50 is destroyed.

Tube 16 has an inner safety wall 18 disposed adjacent grinding element 20, and wall 18 has an oblong opening 19 that allows through passage of a coded end portion of a key 50. As holder 25 and a gripped key 50 are inserted into tube 16, they are rotated until a coded end 51 of key 50 passes through oblong opening 19 and into engagement with rotating abrasive disk 20. A head portion 52 of key 50 will not fit through oblong opening 15 and is blocked by safety wall 18 so that only the coded end portion 51 of key 50 can be ground away. Holder 25 and the head portion 52 of destroyed key 50 can then be withdrawn from tube 16.

Holder 25 is preferably a file holder that is readily available as a tool to attach to and grip a tang end of a file. Knob 26 of holder 25 rotates to open and close holder jaws 27 that grip head 52 of key 50. Preferably a screw 53 is added to the jaws 27 of holder 25 to detent into a hole that is normally available in the head of a key 50. This is to ensure a firm grip on the head of a key, which then cannot escape from the jaws of holder 25 during the destruction process.

Key head 52 can bear a serial number or other identification number that can identify which copy of a particular key has been destroyed, because the head 52 of a destroyed key can remain as a permanent record. Abrasive element 20, suitable for use in angle grinders, is inexpensive and readily replaced when worn. A wrench 60 with an offset head 61 is configured to reach within enclosure 15 to loosen or tighten the attachment of abrasive disk 20 to grinder 10.

The orientation of oblong opening 19 in safety wall 18 of tube 16 preferably disposes the long axis of opening 19 radially of grinding disk 20. This orients the maximum width of the coded portion of key 50 transverse to the direction of rotation so that abrasive disk 20 grinds away the coded portion 51 along the widest possible path. This helps speed up the grinding process and prolong the life of grinding disk 20.

Cover 17, with tube 16, safety wall 18, and oblong key opening 19, all cooperate to ensure that the metal particles that are ground away from a key 50 are retained within grinding chamber 15. This ensures that ground particles do not escape and injure an operator. Cover 17 is preferably removable so that metal particles can be emptied from chamber 15.

Chamber 15 is preferably configured so that it can rest on a horizontal surface that also supports angle grinder 10 in a stable position while keys are being destroyed. Then all that is necessary is to grip the head of a key securely in the jaws 27 of holder 25, start angle grinder 10, and advance the holder in a key foremost direction into tube 16. Holder 25 can then be rotated as necessary to fit coded portion 51 through slot 19 to contact abrasive disk 20. The cooperative configuration of these components helps prevent accidents or any harm to the user or to the equipment. Only the coded portion 51 of a key 50 can be ground away, because safety wall 18 will not permit passage of anything else into the grinding region against disk 20. Tube 16 also supports holder 25 in a sliding fit, which ensures that holder 25 and the key that it grips cannot be forced off the intended path of direct axial insertion of the coded portion 51 of key 50 into engagement with abrasive disk 20. A user does not have to exert a muscle force to keep key 50 properly aligned and aimed at its destination.

What is claimed is:

1. A key destroyer comprising:

a grinding element;

a motor arranged to move the grinding element;

an enclosure for the grinding element;

a tube leading into the enclosure to a grinding area within the enclosure;

a key holder having jaws that releasably grip a head of a key to be destroyed;

the key holder, with a key gripped by the holder, being slidable into the tube so that a coded end of the key advances toward the grinding area;

a safety wall at an inner end of the tube having an oblong opening orienting the coded end of the key and admitting only the coded end of the key into contact with the grinding element so that advancing the holder and the gripped key grinds away only the coded end of the key; and the tube and the safety wall support the key and the key holder against lateral force applied by the grinding element in grinding away the coded end of the key, the head of which can then be removed from the holder jaws.

2. The key destroyer of claim 1 wherein the oblong opening is positioned to orient an advancing key to contact the grinding element across a maximum width of the coded end of the key.

3. The key destroyer of claim 1 wherein the enclosure and the motor form a stand supporting the key destroyer on a generally horizontal surface.

4. The key destroyer of claim 1 wherein the key holder is a file holder whose gripping jaws include a detent entering a hole in a head of the key.

5. The key destroyer of claim 1 wherein the enclosure, the tube, and the safety wall are arranged to capture and retain metal particles ground from the key.

6. The key destroyer of claim 5 including a cover removable from the enclosure to empty the enclosure of ground metal particles.

7. The key destroyer of claim 1 wherein the grinding element is replaceable.

8. A key destroyer comprising:

a motor driven grinding element;

a guide tube supported in a position approaching the grinding element;

a key holder slidable within and supported by the guide tube;

the key holder having jaws that releasably grip a head of a key to be destroyed; and the tube being configured to receive the key holder gripping the key as the holder advances a coded portion of the key through an oblong opening in a safety wall and into engagement with the grinding element to grind away only the coded portion of the key.

9. The key destroyer of claim 8 wherein the tube is formed as part of an enclosure around the grinding element.

10. The key destroyer of claim 9 wherein the tube, the holder, and the enclosure are arranged to capture and retain metal particles ground from the key.

11. The key destroyer of claim 8 wherein the tube includes an inner wall configured to form the oblong opening allowing orienting of only the coded portion of the key to advance into contact with the grinding element.

12. The key destroyer of claim 10 wherein the tube orients the coded portion of the key to engage a maximum width of the grinding element.

13. The key destroyer of claim 8 wherein an enclosure for the grinding element catches and retains ground metal key particles.

14. A key destroying method comprising:

gripping a head of a key in jaws of a holder;

using the holder to advance a coded portion of the gripped key through a supporting tube toward a motor driven grinding element;

configuring the tube to have an oblong opening admitting only the coded portion of the key into contact with the grinding element;

using the tube to brace the holder and the gripped key against force applied by the grinding element in grinding away only the coded portion of the key, and releasing the holder jaws to remove the head of the ground-away key.

15. The method of claim 14 including using the oblong opening of the tube to orient the key so that the coded portion of the key engages a maximum width of the grinding element.

16. The method of claim 14 including enclosing the grinding element so as to collect ground metal from destroyed keys within the enclosure.

17. The method of claim 16 including forming the tube as part of the enclosure.

18. The method of claim 14 including configuring the holder jaws to enter a hole in a head of the key as the holder jaws grip the head of the key.

19. The method of claim 14 including arranging the tube and an enclosure for the grinding element to prevent escape of ground metal particles.

20. A key destroyer comprising:

a holder having jaws adapted to releasably grip a head of a key;

a supporting tube through which the holder, and a key gripped by the holder, can advance key-foremost through the tube toward a motor driven grinding element;

the tube being configured with an oblong opening admitting only a coded portion of the key into contact with the grinding element; and the tube being arranged to brace the holder and the gripped key against force applied by the grinding element in grinding away only the coded portion of the key, leaving the head of the key to be released from the jaws of the holder.

21. The key destroyer of claim 20 wherein the grinding element has an enclosure and the tube is formed to extend into the enclosure.

22. The key destroyer of claim 21 wherein the enclosure collects ground metal from destroyed keys.

23. The key destroyer of claim 21 wherein the oblong opening is formed in an inner end wall of the tube.

24. The key destroyer of claim 20 wherein the holder jaws are configured to engage a hole in the head of the key.

25. The key destroyer of claim 20 wherein the enclosure, the tube and the holder are arranged to protect a user from ground metal key particles.

* * * * *